United States Patent [19]

Sadamatsu et al.

[11] 4,170,476

[45] Oct. 9, 1979

[54] LAYERED PHOTOCONDUCTIVE ELEMENT HAVING AS AND/OR TE DOPED WITH GA, IN OR TL INTERMEDIATE TO SE AND INSULATOR

[75] Inventors: Shigeru Sadamatsu; Kozo Oka, both of Minami-ashigara, Japan

[73] Assignee: Fuji Xerox Co., Ltd., Tokyo, Japan

[21] Appl. No.: 811,925

[22] Filed: Jun. 30, 1977

[30] Foreign Application Priority Data

Jun. 30, 1976 [JP] Japan ..... 51-77265

[51] Int. Cl.[2] ..... G03G 5/09

[52] U.S. Cl. ..... 96/1.5 N; 96/1 PC

[58] Field of Search ..... 96/1 S, 1 PC

[56] References Cited

U.S. PATENT DOCUMENTS

| | | | |
|---|---|---|---|
| 3,615,413 | 10/1971 | Fisher et al. | 96/1.5 |
| 3,655,377 | 4/1972 | Sechak | 96/1.5 |

*Primary Examiner*—John D. Welsh

*Attorney, Agent, or Firm*—Sughrue, Rothwell, Mion, Zinn and Macpeak

[57] ABSTRACT

A photosensitive material for electrophotography comprising a support having thereon a photoconductive layer and an electrically insulating layer, in which the photoconductive layer is a vacuum-deposited film substantially comprising Se with a surface layer portion of the vacuum-deposited film contacting the electrically insulating layer containing, within a thickness of about 10 μ or less, about 1 to about 50% by weight of As and/or Te and about 0.5 to about 1000 ppm of at least one element of Group IIIb of the Periodic Table.

10 Claims, No Drawings

LAYERED PHOTOCONDUCTIVE ELEMENT HAVING AS AND/OR TE DOPED WITH GA, IN OR TL INTERMEDIATE TO SE AND INSULATOR

BACKGROUND OF THE INVENTION

1. Field of the Invention

This invention relates to a photosensitive material for electrophotography and more particularly, to a photosensitive material for electrophotography which comprises a support, a photoconductive layer and an electrically insulating layer, which can be suitably employed in an electrophotographic method for the formation of an electrostatic latent image and which has high sensitivity, panchromatic sensitivity and electric charging ability.

2. Description of the Prior Art

In known electrophotographic methods, it is a common practice to reproduce an image by providing a photoconductive layer on an electrically conductive support, electrically charging the photoconductive layer surface using a corona discharger or a like device, exposing the surface to light in an imagewise pattern to permit the electric charge in the exposed area to discharge whereby an electric charge remains in an imagewise pattern to form an electrostatic latent image on the surface, developing the latent image with colored charged particles, transferring the developed and colored particle image to paper or another support, and fixing the transferred image. In this process, amorphous selenium, zinc oxide and like materials are generally used as materials for the photoconductive layer.

Although the process is very simple in operation since the electrostatic latent image can be formed in the two steps of charging and exposing, several problems exist in the method in that the photoconductive layer is susceptible to damage since the photoconductive layer is the outermost layer, with the possibility of an attendant unattractive image, and in that the photoconductive material is harmful to the human body due to its toxicity and is thus disadvantageous from the viewpoint of safety.

U.S. Pat. No. 3,041,167 describes another type of electrophotographic method in which a photosensitive element provided with an electrically insulating layer on the outer surface thereof is used for formation of an electrostatic latent image. In this process, an electrostatic latent image is formed by the steps of electrically charging to a given polarity an electrically insulating layer surface of a photosensitive element of a three-layer structure comprising an electrically conductive support, a photoconductive layer and an electrically insulating layer, uniformly exposing the element to light to produce an electric charge with a polarity opposite that of the first charging at the interface between the photoconductive layer and the electrically insulating layer, subjecting the electrically insulating layer surface to a second charging in a polarity opposite that of the first charging for neutralization of the surface electric charge, and exposing the element to light in an imagewise pattern to form an electrostatic latent image at the interface between the electrically insulating layer and the photoconductive layer. As will be understood from the above, the electrically insulating layer must be transparent to radiation such as light or X-rays to which the photoconductive layer is sensitive.

The electrophotographic process using a photosensitive element of the type described immediately above has a number of advantages. One advantage is that the surface of the photoconductive layer itself is not damaged since the steps of developing, transferring, cleaning, etc., are carried out on the surface of the electrically insulating layer. Another advantage is that the photosensitive element is usable over a long period of time by an appropriate selection of an electrically insulating material with high hardness. A further advantage is that no special care needs to be taken with regard to the toxicity of the photoconductive material since the photoconductive layer is covered with the electrically insulating layer.

However, the process described in U.S. Pat No. 3,041,167 has a disadvantage. That is, in the known electrophotographic process, the charging is effected by depositing ions from a corona discharger on the surface of a photosensitive material. While, in the process of the U.S. Pat. No. 3,041,167, the charging is conducted by transferring charge carries from the electrically conductive support to the interface between the photoconductive layer and the electrically insulating layer, so that the charge carries tend to dissipate unless there is a satisfactory charge retention in the neighborhood of the surface of the photoconductive layer. Accordingly, a high charging current is disadvantageously required in the first charging step in order to create a quite high electric field and to cause a large amount of charge carriers to be produced. In addition, such a high charging current undesirably involves the generation of ozone. This disadvantage is emphasized especially when a highly sensitive material such as a Se alloy containing As and/or Te is employed as the photoconductive layer.

In order to improve the charging ability, an attempt has been made to use a material with high electrical resistance as a surface layer of the photoconductive layer. However, such an attempt is disadvantageous not only in reducing the sensitivity of the photosensitive material, but also in increasing the residual potential when the photosensitive material is repeatedly employed.

SUMMARY OF THE INVENTION

Under these circumstances, an object of the present invention is to provide a photosensitive element with which a satisfactory electrostatic contrast by treatment with a small charging current can be assured and, with which high sensitivity, high panchromatic sensitivity and low residual potential can be attained.

The invention provides a photosensitive material of a three-layer structure which includes a support having thereon a photoconductive layer and an electrically insulating layer, in which the photoconductive layer is a film vacuum-deposited on the support and substantially comprises Se, and the upper layer portion of the photoconductive layer, i.e., the surface layer portion contacting the electrically insulating layer, within a thickness range of about 10$\mu$ or less contains about 1 to about 50% by weight of As and/or Te and about 0.5 to about 1000 ppm of at least one element of Group IIIb of the Periodic Table such as Tl, In, Ga or the like.

DETAILED DESCRIPTION OF THE INVENTION

As described above, the surface layer portion containing the As and/or Te and the element of Group IIIb has a thickness about 10$\mu$ or less. A thickness greater than 10μ is undesirable due to an increase of residual potential upon repetition of image formation. A suitable thickness can range from about 0.01 to about 10μ or less. The addition of As and/or Te is intended to expand, up to the red light spectral range, the spectral sensitivity of Se which is inclined toward the blue or the bluish green spectral range, thereby imparting a panchromatic spectral sensitivity to the Se. The amount of As and/or Te preferably ranges from 10 to 50 wt %.

The positive holes in the Se layer are mainly transferred as charge carriers, but the element of Group IIIb serves as a trap center for catching the positive holes. When, for example, an element of Group IIIb is uniformly added to Se and the mixture is formed into a single deposited film layer, the residual potential of the layer becomes fairly high after charging and exposure. If an element of Group IIIb is added to the surface layer portion alone, the residual potential does not increase and the charging ability is improved. The photosensitive material sensitized by addition of Te and/or As has a poor charging ability. Addition of an element of Group IIIb to such a photosensitive material greatly improves the charging ability. That is, when an element of Group IIIb is added in an amount as small as about 0.5 to 1000 ppm, the charging ability alone can be improved without adversely influencing other important characteristics. In this connection, however, dispersion of an element of Group IIIb throughout the entire photoconductive layer results in an increase of the residual electric charge, so that the element of Group IIIb preferably is dispersed together with As and/or Te in the surface layer portion alone within a thickness from the surface of less than about 10μ. A preferred thickness is above about 0.1μ since a stable charge retention and sensitization of the surface layer portion is obtained. A preferred thickness range is 0.1 to 2.0μ.

The lower portion of the photoconductive layer substantially comprises Se, but may contain As, Te or a halogen or a mixture thereof. When As and/or Te are present in the lower portion of the photoconductive layer for sensitization, the content of As and/or Te preferably ranges from 0.1 to 50% by weight. The As and/or Te may be uniformly or nonuniformly distributed throughout the photoconductive layer. However, the amount of As and/or Te present in the upper portion of the photoconductive layer is preferably greater than that in the lower portion of the photoconductive layer. A halogen is employed to sensitize the photoconductive layer and to prevent a build-up of residual potential. Where a halogen, (namely a halogen) such as chlorine, bromine and iodine, is present together with the As and/or Te in the lower portion of the photoconductive layer, or where a halogen is present alone, a suitable amount of the halogen is about 1 to about 30,000 ppm. The thickness of the overall photoconductive layer preferably ranges from 10 to 200μ.

The electrically insulating layer should preferably have a high electrical resistance e.g., higher than about $10^{11}\Omega$·cm, preferably higher than $10^{13}$106 ·cm, a high electrical charge retention and excellent abrasion resistance and must be transparent to radiation such as light or X-rays to which the photoconductive layer is sensitive. Examples of suitable electrically insulating materials include films of polymers such as urethane resins, polyester resins, fluorocarbon resins, polycarbonate resins, polyolefin (e.g., polyethylene) resins, cellulose acetate resins, and films of inorganic electrically insulating materials such as glass, ceramics, etc., containing $SiO_2$, $Al_2O_3$ and like materials. The thickness of the electrically insulating layer preferably ranges from 5 to 50μ. With a thickness below 5μ, the mechanical strength is insufficient. In contrast, with a thickness above 50μ, the image resolution is reduced.

The support can be an electrically conductive support, an electrically insulating support and a support obtained by combining an electrically conductive layer and an electrically insulating layer. Suitable conductive supports can be made of any electrically conductive materials, for example, a metal conductor such as aluminum, copper, tin, etc., a synthetic resin film treated so as to be rendered electrically conductive, a hygroscopic paper, a paper laminated with an aluminum foil, and the like. Suitable electrically insulating supports can be any organic and inorganic materials which are electrically insulating, and they do not need to satisfy the requirements for the electrically insulating layer.

The photosensitive material of this invention can be prepared as follows. Firstly, a photoconductive layer comprising mainly Se is vacuum-deposited on a support and secondly Se containing As and/or Te or an element of Group IIIb is vacuum-deposited thereon, so that the thickness of the surface layer is less than about 10μ.

The photosensitive material of the invention can be used in all types of electrophotographic processes, e.g., as described in U.S. Pat. Nos. 3,041,167, 3,666,363 and 3,676,117 in which a positive electric change is retained in the interface between the photoconductive layer and the electrically insulating layer.

The present invention will be particularly described in greater detail in the following examples. The invention is not to be construed, however, as being limited to these examples. Unless otherwise indicated, all parts, percents, ratios and the like are by weight.

EXAMPLE 1

70 parts of Se, 30 parts of Te and 100 ppm of $Tl_2Se_3$ were introduced into a quartz tube under vacuum, and heated and melted at about 500° C. for about 6 hours to obtain a uniform dispersion. The melt was poured into distilled water to form a granular solid, followed by drying sufficiently. Then, a Se film with a thickness of 60μ was formed by vacuum deposition on an aluminum substrate maintained at a temperature between 60° C. and 80° C., on which was further vacuum-deposited a 0.5μ thick photoconductive layer using the Se-Te-Tl solid mixture obtained as described above. Thereafter, a 12μ thick polyester film was adhered to the photoconductive layer using an epoxy resin, thereby obtaining a photosensitive material or element.

The photosensitive element was electrically charged on the electrically insulating layer surface thereof using a corona discharger at −5.5 KV, exposed overall to light in a light quantity of about 1 lux. sec, again charged using a corona discharger at +5.5 KV, and finally exposed to light in an imagewise pattern in a light quantity of about 1 lux. sec to obtain a latent image having an electrostatic contrast of about 800 V. The latent image was developed using a cascade method e.g., as disclosed in U.S. Pat. No. 2,880,696, to obtain an image of good quality.

EXAMPLE 2

A solid mixture of 60 parts of Se, 40 parts of As and 20 ppm of In and obtained in a manner similar to that described in Example 1 was vacuum-deposited in a thickness of 0.5μ on a Se layer which had been vacuum-deposited on an aluminum substrate in a thickness of 60μ, thereby forming a photoconductive layer. A urethane resin was then applied onto the photoconductive layer to form a surface electrically insulating layer. Then, the procedures of Example 1 were repeated to obtain an image of good quality.

EXAMPLE 3

A solid mixture of 70 parts of Se, 15 parts of Te and 500 ppm of Ga and obtained in a manner similar to that described in Example 1 was vacuum-deposited in a thickness of 0.3μ on a Se layer which had been vacuum-deposited on an aluminum substrate in a thickness of 60μ, thereby forming a photoconductive layer. A urethane resin was then applied onto the photoconductive layer to form a surface electrically insulating layer thereon. Thereafter, the procedure of Example 1 was repeated to obtain an image of good quality.

While the invention has been described in detail and with reference to specific embodiments thereof, it will be apparent to one skilled in the art that various changes and modifications can be made therein without departing from the spirit and scope thereof.

What is claimed is:

1. A photosensitive element for electrophotography comprising a support having thereon a photoconductive layer and an electrically insulating layer thereon on the surface thereof remote the support, in which the photoconductive layer is a vacuum-deposited film substantially comprising Se with a surface layer portion thereof contacting the electrically insulating layer containing, within a thickness of about 10μ or less, about 1 to about 50% by weight of As and/or Te and about 0.5 to about 1000 pm of at least one element selected from the group consisting of Ga, In, Tl of a mixture thereof.

2. The photosensitive element of claim 1, wherein the amount of As and/or Te ranges from 10 to 50 weight % and the thickness of said surface layer portion is 0.1 to 2.0μ.

3. The photosensitive element of claim 1, wherein said electrically insulating layer is transparent to radiation to which said photoconductive layer is sensitive and is selected from the group consisting of a urethane resin, a polyester resin, a fluorocarbon resin, a polycarbonate resin, a polyolefin resin, a collulose acetate resin, a glass, or a cermic.

4. The photosensitive element of claim 1, wherein said support is an electrically conductive support, an electrically insulating support or a support obtained by combining an electrically conductive material and an electrically insulating material.

5. The photosensitive element of claim 1, consisting essentially of, in order, said support, said photoconductive layer, and said electrically insulating layer.

6. The photosensitive element of claim 1, wherein said element of Group IIIb of the Periodic Table is Tl.

7. The photosensitive element of claim 1, wherein said element of Group IIIb of the Periodic Table is Ga.

8. The photosensitive element of claim 1, wherein said electrically insulating layer has an electrical resistance higher than about $10^{11}$ Ω·cm.

9. The photosensitive element of claim 1, wherein said electrically insulating layer is transparent to radiation to which the photoconductive layer is sensitive.

10. The photosensitive element of claim 1, wherein the thickness of the electrically insulating layer ranges from 5 to 50 μ.

* * * * *